United States Patent [19]

Masuda et al.

[11] Patent Number: 4,647,474

[45] Date of Patent: Mar. 3, 1987

[54] PROCESS FOR PRODUCING AN INSULATED TWISTED ELECTRIC WIRE

[75] Inventors: Shigeo Masuda; Morihiko Katsuda; Isao Ueoka, all of Aichi, Japan

[73] Assignee: Sumitomo Electric Industries, Ltd., Osaka, Japan

[21] Appl. No.: 744,724

[22] Filed: Jun. 14, 1985

[30] Foreign Application Priority Data

| | | | |
|---|---|---|---|
| Jun. 14, 1984 | [JP] | Japan | 59-122327 |
| Jun. 14, 1984 | [JP] | Japan | 59-122328 |
| Jun. 14, 1984 | [JP] | Japan | 59-122329 |
| Jun. 14, 1984 | [JP] | Japan | 59-122330 |
| Jul. 2, 1984 | [JP] | Japan | 59-137791 |
| Sep. 14, 1984 | [JP] | Japan | 59-193590 |
| Nov. 1, 1984 | [JP] | Japan | 59-231837 |

[51] Int. Cl.[4] ..... B05D 3/06

[52] U.S. Cl. ..... 427/44; 427/54.1; 427/118

[58] Field of Search ..... 427/44, 54.1, 118; 118/420

[56] References Cited

U.S. PATENT DOCUMENTS

| | | | |
|---|---|---|---|
| 2,266,392 | 12/1941 | Durant et al. | 118/420 |
| 2,438,956 | 4/1948 | Warner | 427/118 |
| 3,196,060 | 7/1965 | Priaroggia | 118/420 |
| 3,291,639 | 12/1966 | Flowers et al. | 427/118 |
| 4,342,794 | 8/1982 | Volker et al. | 427/54.1 |

*Primary Examiner*—John H. Newsome

*Attorney, Agent, or Firm*—Sughrue, Mion, Zinn, Macpeak & Seas

[57] ABSTRACT

A process for producing an insulating twisted electric wire having a reduced overall diameter with an insulating coating of high quality. The insulating coating has a thickness in a range of 3 to 100% of the radius of a smallest circle circumscribing the assembled set of twisted conductors. The insulating coating is formed by two or more cycles of coating and curing an insulating paint. Preferably, a bottom layer of the insulating coating is formed by applying a heat-curable insulating paint with a felt applicator or with a roller coating device. The heat-curable insulating paint should have a viscosity of not more than about 300 cps at 30° C.

4 Claims, 7 Drawing Figures

PROCESS FOR PRODUCING AN INSULATED TWISTED ELECTRIC WIRE

BACKGROUND OF THE INVENTION

The present invention relates to a process for producing insulated electric wires used for wiring in a variety of electronic devices. More particularly, the invention relates to a process for producing a twisted wire having conductors with a thin insulating coating provided by applying insulating paint to the conductors and baking the applied layer.

Insulated wires of a type used for wiring in a large variety of electronic devices are conventionally produced by extruding a covering of insulating material over twisted conductors. Such insulated wires have been used either independently or as conductors for shielded wires, coaxial cables or flat cables.

With the recent tendency to smaller and lighter electronic devices, considerable efforts are being made to further reduce the cross-sectional size of insulated wires, shielded wires and cables. One way of doing this is to reduce the thickness of the insulating coating. It is very difficult, however, to form an adequately thin insulation coating with current extrusion techniques. An alternative that has been proposed is to provide a thin insulating coating by multiple applications and curings of insulating paint. In actual operation, however, problems such as blistering of the coating or entrapment of air bubbles within the coating occur during the steps of applying the isulating paint to the twisted conductors and curing the applied paint. More specifically, when the insulating paint applied to twisted conductors is cured, air left in gaps between twisted conductors, as shown in FIG. 1, will expand as a result of heating to cause blistering in the surface of the coating. This problem can be significantly reduced by baking the applied paint at lower temperatures, for instance, 150° C. or below, but then the coating finally obtained does not harden sufficiently to provide a reliable twisted insulated wire.

SUMMARY OF THE INVENTION

In order to solve the problems described above, the present inventors have conducted various studies to find an effective method to produce twisted wires with a thin insulating coating and have successfully developed a method capable of forming an insulating coating on twisted metal conductors without causing blistering or leaving air bubbles entrapped within the coating.

As mentioned above, when an insulating coating is formed on twisted conductors by the conventional method of applying and curing insulating paint, air left in gaps (indicated at 2 in FIG. 1) between conductors expands upon heating and causes frequent blistering. When air is heated at a given pressure from, for example, room temperature (20° C.) to 250° C., its volume increases by a factor of about 1.8.

The present invention has been accomplished as a result of the intensive studies conducted by the inventors to develop techniques for preventing the occurrence of a blistered insulating coating resulting from such an increase in air volume to thus eliminate entrapped air bubbles. The insulating coating formed in accordance with the present invention is characterized by being thinner than the coating formed by conventional extrusion techniques, specifically, the coating thickness is within a range of 3 to 100% of the radius of the smallest circle that circumscribes the set of twisted conductors. If the coating's thickness is less than 3% of the radius of the circumscribing circle, a highly reliable insulated wire will not be obtained, and if the thickness of the insulating coating is more than 100% of the radius of the circle, the method of the present invention provides no specific benefits as conventional extrusion techniques will serve as well.

In accordance with one aspect of the present invention, at least the bottom layer of the insulating coating on the twisted conductors is formed by applying a thin layer of heat-settable insulating paint with a felt applicator or by roller coating, and then hardening the applied layer so as to produce an insulated twisted wire having no blistered insulating coating.

In accordance with another aspect of the present invention, at least the bottom layer of the insulating coating on the twisted conductors is formed by applying a thin layer of heat-settable insulating paint having a viscosity of not more than 300 cps at 30° C., and then hardening the applied layer so as to produce an insulated twisted wire having no blistered insulating coating.

In accordance with a further aspect of the present invention, the twisted conductors are first wetted with a solvent, and then a heat-settable insulating paint is applied and hardened so as to produce an insulated twisted wire having no blistered insulating coating.

In accordance with still another aspect of the present invention, an aqueous electrolytic paint is electrodeposited on the twisted conductors, and after heating, an insulating paint is applied and subsequently hardened so as to produce an insulated twisted wire having no blistered insulating coating.

In accordance with a still further aspect of the present invention, a radiation-settable paint is applied to the twisted conductors, and the applied layer is then hardened so as to produce an insulated twisted wire having no blistered insulating coating. This fifth aspect of the present invention includes an invention directed to the elimination of air bubbles from the applied insulating layer before it hardens.

DESCRIPTION OF THE PREFERRED EMBODIMENTS

The above-mentioned aspects of the present invention are hereunder described in more detail.

When twisted conductors are provided with an insulating coating by drawing them through a die subsequent to a tank of insulating paint, the die of course must have a bore diameter larger than the outside diameter of the smallest circle that circumscribes the set of twisted conductors. This provides an unnecessarily thick coating between conductors, and the expansion of air in the gaps between conductors and the evaporation of the solvent in the paint will lead to an increased chance of blistering of the finally obtained insulating coating. As a matter of fact, twisted conductors having a blistered, and hence hard, coating will often break to make further wire fabrication impossible. A thinner insulating coating could be formed by using a die having a bore size substantially equal to the outside diameter of the smallest circle that circumscribes the set of twisted conductors, but this causes rapid wear of the die, or variations in the outside diameter of the circumscribing circle along the length of the conductors introduce an unevenness in the friction between conductors and the die, making it impossible to provide a uniform insulating coating over the entire length of the conductors.

In accordance with the first aspect of the present invention, at least the bottom layer of the insulating coating on the twisted conductors is formed by applying a thin layer of heat-settable insulating paint with a felt applicator or by roller coating, and then hardening the applied layer so as to produce an insulated twisted wire having no blistered insulating coating.

As mentioned above, the applied heat-settable insulating paint will first fill the gaps between the twisted conductors. When this paint is heated, air entrapped either between the conductors or within the paint will expand and pass outside the applied layer, causing blistering. The present inventors, however, have confirmed by experiment that when the amount of paint given by a single application with a felt applicator or by roller coating is selected so that $AC \leqq (AB/2)$ (see FIG. 1), the expanded air between the conductors can easily escape before the applied coating hardens completely, thus forming an unblistered insulating coating.

Figure 1:
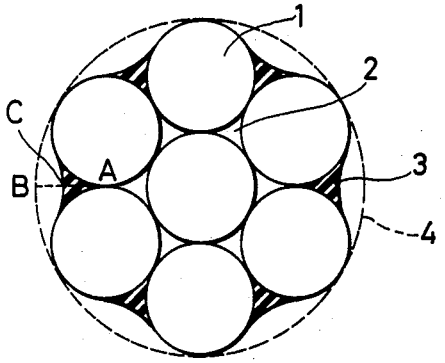
FIG. 1 is a cross section of a set of twisted conductors having a coating of insulating paint.

The thickness of the coating corresponding to AB in FIG. 1 is preferably provided by two to five applications, and if a greater thickness is desired, the coated conductors may be subsequently drawn through a die having the proper bore size. Once an insulating coating of a thickness of about 2 to 4 microns is obtained by application with a felt applicator or by roller coating, the subsequent application may be efficiently performed with a die, offering a great commercial advantage in that the total number of coating and baking cycles is reduced.

In order to provide a coating thickness of about 20 to 25 microns on a set of seven twisted conductors each having a diameter of 0.06 mm, at least 10 to 15 coating cycles are needed if the individual layers are formed with only a felt applicator or by roller coating. A thick layer cannot be formed by one application with a felt applicator or by roller coating without causing unevenness along the length of the conductors, and therefore thin layers must be applied as many times as are necessary for achieving the desired thickness. However, the necessity for providing many thin layers imposes limits on the number of die heads that can be installed within a given width of the oven, and this leads to reduced productivity, which is a serious problem in actual operations. Therefore, twisted conductors provided with a thin and unblistered layer of insulating paint should preferably be passed through a die in order to determine the remaining coating thickness. By doing so, the desired insulating wire can be produced efficiently and without blistering of the insulating coating.

The felt applicator used in the first aspect of the method of the present invention may be made of any of a number of conventional materials such as wool, polyester, Teflon, polypropylene, polyvinylidene chloride and rayon. The density of the felt is selected from the range of 0.20 to 0.60 g/cm$^3$. The shape and material of the die may be such that it allows for the application of insulating paints commonly used in the production of enamelled wires. Suitable die materials include sintered hard alloys, sintered synthetic diamond, sapphire, synthetic diamond, and natural diamond, and they may be provided with bores of proper shape for use as dies. Any of the roller coating methods that are commonly used in the production of enamelled wires may be employed.

In accordance with the second aspect of the present invention, the bottom layer of insulating coating on the twisted conductors is formed by at least one cycle of felt applicator or roller coating and baking of a heat-settable insulating paint having a viscosity of not more than 300 cps (as measured by a Brookfield Viscometer at 30° C.), and subsequently, at least one more layer of the overall insulating layer is applied and cured so as to produce an insulated twisted wire harving an unblistered insulating coating.

As already mentioned, the principal causes of blistering are (1) air entrapped in the gaps between conductors, and (2) evaporation of solvent in the insulating paint. The present inventors have confirmed that the first cause can be eliminated by applying a thin layer of heat-settable insulating paint with a felt applicator or by roller coating so as to facilitate the escape of air from between conductors. As a result of continued studies on blistering, the present inventors have found that this effect is correlated to the viscosity of the heat-settable insulating paint, particularly that of the bottom layer of such paint on conductors. Therefore, not only the coating thickness but also the viscosity of heat-settable insulating paint must be considered if it is to form the first layer on the twisted conductors.

The heat-settable insulating paint applied to the twisted conductors experiences a temporary drop in viscosity while the conductors are passed through a baking chamber. The air between conductors expands as a result of heating and escapes through the paint. The viscosity of the paint is measured for its resistance to the escaping air. If the paint has a high viscosity, the entrapped air will not easily escape from the system, increasing the chance of formation of a blistered coating. Even if the entrapped air escapes from the system, the viscous paint will not provide a smooth-surfaced coating, in spite of its surface tension. The present inventors have confirmed by experiment that in order to prevent blistering, the insulating paint preferably must have a viscosity of not more than 300 cps (as measured by a Brookfield Viscometer at 30° C.). The more preferred range is up to 200 cps, with the range of up to 100 cps being particularly preferred.

Heat-curable insulating paint having such a low viscosity experiences a further drop in viscosity, and as a consequence, the expanded air will escape more easily. The present inventors have confirmed by further experiments that any unevenness that might be introduced into the surface of the paint coating when the air escapes is easily eliminated by the action of surface tension, producing a smooth-surfaced coating. According to the finding of the present inventors, the bottom coating layer having the thickness corresponding to AB in FIG. 1 can be produced by a single application of a heat-curable insulating paint having a viscosity of not more than 300 cps without causing blistering.

An insulating paint having a viscosity higher than 300 cps may be used in forming subsequent coating layers because any air that is entrapped between conductors will have escaped during the application of the bottom coating layer. Even if there remains a certain amount of air, it is entrapped in the cured bottom layer and will cause no blistering of the second layer. However, in order to avoid blistering resulting from the evaporation of the paint solvent, the second and subsequent coating layer should not have an excessively great thickness and they should thus not be formed from an extremely viscous insulating paint. If a felt applicator is used, an insulating paint having a viscosity of up to about 700 cps is preferably used in the deposition of the second and subsequent coating layer. If a die is used, an insulating paint having a viscosity of up to 500 cps is preferably used.

Figure 2:
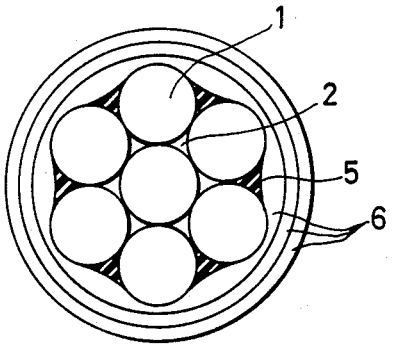
FIG. 2 is a cross section of an insulated twisted wire fabricated in accordance with the present invention.

FIG. 2 shows a cross section of an insulated twisted wire having multiple insulating coating layers, wherein the second and subsequent insulating coating layers are collectively indicated at 6. In actual operation, the selection of a felt applicator or die and the number of coating applications must be properly determined depending upon the desired properties of the wire and the final coating thickness.

Any ordinary insulating paint may be used by proper adjustment of the viscosity. Needless to say, the choice of the insulating paint used also depends on the required characteristics of the final insulated wire.

In accordance with the third aspect of the present invention, twisted conductors are first dipped in a solvent or otherwise coated with a solvent before a heat-curable insulating paint is applied, and then hardened by heating so as to produce an insulated twisted wire having no blisters in the insulating coating. If the surfaces of the individual twisted conductors are wetted by the solvent, the blistering that may occur in the subsequent application and baking of a heat-curable insulating paint can be appreciably reduced. The method in accordance with this third aspect of the invention has a great commercial advantage in that insulated twisted wires having no greater incidence of blistering than conventional enamelled wires can be produced. The principal reason why wetting the conductors with a solvent reduces the chance of blistering appears to be that either the solvent displaces part of the air entrapped between conductors so that it is forced to the outside, or that the insulating paint subsequently easily displaces any residual air so as to reduce the chance of air expansion during heating.

The solvent used must be miscible with the insulating paint applied in the subsequent step. If the insulating paint is polyvinylformal, any of polyurethane, polyester or polyesterimide, cresylic acids, xylene, toluene or naphtha may be used as solvents either individually or in admixtures. If polyamideimide or polyimide is used as an insulating paint for the fabrication of heat-resistance coils, pyrrolidone may be used as the principal solvent and diluted with xylene, toluene or naphtha. Suitable solvents should be selected depending on the case.

The solvents listed above that are applied to the twisted conductors before treatment with an insulating paint may be used either alone or in mixtures, and they should preferably have good miscibility with both the resin and the solvent in the paint. The solvents may be applied from a felt applicator impregnated therewith. Alternatively, they may be applied by roller coating or by dipping the conductors in a solvent bath, followed by wiping the excess solvent so as to provide a uniform solvent coating.

Any contaminant, such as metal powder, remaining on the surface of the conductors may cause blistering even if the surface is preliminarily coated with a solvent. In order to avoid this problem, the surfaces of the twisted conductors may be electrolytically cleaned in an aqueous electrolyte, washed with hot water, and subsequently dried prior to the coating of a solvent. These procedures ensure the formation of an unblistered coating, having a thickness corresponding to AB in FIG. 1, by a single application of the heat-curable insulating paint.

Figure 3:
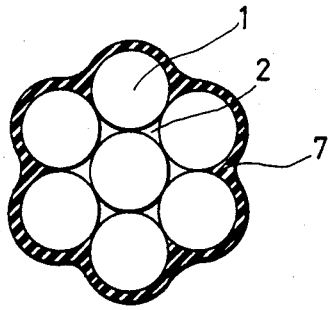
FIG. 3 is a cross section of a set of twisted conductors which is provided with a bottom coating formed by electrodepositing an aqueous electrolytic paint.

In accordance with the fourth aspect of the present invention, twisted conductors are coated with an aqueous electrolytic paint by electrodeposition and the applied layer is subsequently baked. In this method, the air entrapped in gaps (indicated at 2 in FIG. 3) between the conductors will escape through the electrodeposited film, thus providing an insulated twisted wire having no blistered insulating coating. Because the electrodeposited film, indicated at 7 in FIG. 3, is more porous than films formed from other conventional insulating paints, air expanded as a result of heating will readily escape and leave no blisters in the coating. Once the applied insulating layer is melted by heating, it provides a barrier against permeation of any residual air from between conductors.

Aqueous electrolytic paints are generally classified into water-soluble and water-dispersible types. Either type produces a resinous deposit on the substrate upon application of a voltage, and the deposit so formed is porous and inevitably contains a certain amount of gas. When the porous resin is subsequently heated, it flows sufficiently to form a uniform coating. More specifically, when the porous resin layer formed on the twisted conductors by electrodeposition is heated, the air in the gaps, indicated at 2 in FIG. 3, will readily expand and penetrate through the resin film. After part of the expanded air has left the resin film, the film is melted by heating, causing it to flow into every part, thereby eliminating porous portions and providing a uniform insulating coating.

Water-soluble electrolytic paints that can be used in the present invention include those which are based on polyvinylformal, polyester, polyurethane, polyacrylics, polyesterimide, polyamideimide and polyimide. These resin components may be modified with epoxy or phenolic resins, and water-soluble electrolytic paints based on such modified resins may also be used in accordance with the present invention.

Water-dispersible electrolytic paints that may be used in the present invention are those which are based on polyacrylics (which are the most common main ingredients of such water-dispersible electrolytic paints), as well as those based on polyurethane, polyvinylformal and polyester. These resin components may be modified with epoxy or phenolic resins, and water-dispersible electrolytic paints based on such modified resins may also be used in accordance with the present invention.

The aqueous electrolytic paints may be cationic or anionic. In the case of cationic electrodeposition paints wherein resins contained as the main ingredients are positively charged, the twisted conductors must be negatively charged. In the case of anionic paints wherein the resins are negatively charged, the twisted conductors should of course be charged positively.

Once an insulating layer that covers at least the portion indicated at 7 in FIG. 3 is applied by electrodeposition and cured thereafter, subsequent coating and curing operations can be carried out using a properly selected insulating paint so that the desired film thickness and wire characteristics are obtained. Insulating paints commonly used in the fabrication of enamelled wires are preferably used, but those which are employed in the manufacture of other types of electric wires may also be employed as well.

As described above, in accordance with the fourth aspect of the present invention, twisted conductors are first electrodeposited with an aqueous electrolytic paint, and after setting the deposited film by heating, any of the conventional insulating paints is applied and hardened so as to provide an insulated twisted wire having an unblistered, and hence highly smooth-surfaced, insulating coating.

In accordance with the fifth aspect of the present invention, a solvent-free radiation-curable paint which will harden at room temperature is applied in layers to twisted conductors until a suitable film thickness is obtained, and the applied layers are thereafter cured by radiating with ultraviolet rays or electron beams so as to entrap air within the space defined by the set of twisted conductors. Subsequently, in order to provide an insulated twisted wire having the desired overall thickness of insulating coating and which exhibits the desired wire characteristics, an insulating paint, which may be either the same as or different from the radiation-hardenable paint, is applied and cured. In accordance with this fifth aspect of the present invention, no blistering of the insulating coating results from the expansion of air in the gaps between conductors, and an insulated twisted wire that can satisfactorily withstand actual service is obtained. The film of the solvent-free radiation-curable paint should cover the hatched area 8 in FIG. 4, and it may be applied with a felt applicator, or by passing through a die, or by any other known technique. The film at 8 in FIG. 4 need not be formed by a single application, and curing of the radiation-curable paint and multiple coating and curing cycles may be repeated in order to provide that film.

As will be apparent from the foregoing description, the problem associated with blistering of an insulating coating that results from the expansion of air in the gaps between the twisted conductors is eliminated by employing any one of the five methods described above.

The present invention also provides two methods for eliminating air bubbles from the applied insulating paint before it hardens. In both methods, at least one layer of a paint that hardens upon radiating by UV rays or electron beams is applied and subsequently cured. In accordance with one of these methods, the conductors provided with a layer of such paint are passed through a heating chamber in order to eliminate any tiny air bubbles that would otherwise remain in the unhardened layer, which is then cured by radiating by UV rays or electron beams. If the radiation-curable paint is applied to the twisted conductors with a felt applicator or by passing through a die, tiny air bubbles present in the paint will not be eliminated by the squeezing action between the inner surface of the die and the conductors, and will be left in the applied layer. If the layer is immediately radiated by UV rays or electron beams, tiny air bubbles will remain in the hardened layer. The inclusion of such tiny bubbles will cause variations in the electrical properties of the final wire and should be eliminated.

Figure 5:
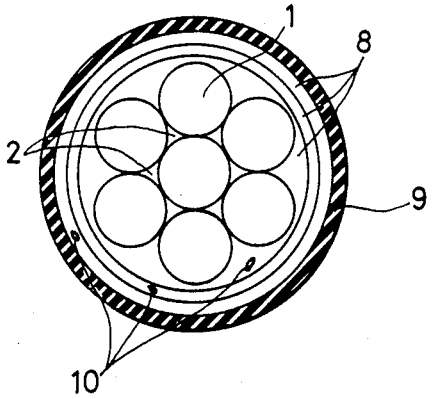
FIG. 5 is a cross section of an insulated twisted wire which has air bubbles contained in the insulating coating since twisted conductors have been immediately introduced into a bath of solvent-free radiation-settable paint without first passing them through a vacuum compartment.

FIG. 5 shows a cross section of an insulated twisted wire having air bubbles entrapped within the insulating coating. As twisted conductors are continuously fed through a bath of radiation-curable paint, air bubbles gradually build up in the paint. The source of these air bubbles is the air that is carried on the conductors and entrapped in the paint. With ordinary bakable insulating paints, heating in the baking chamber causes air bubbles to expand in the applied layer and reduces the viscosity of the paint, thus permitting the expanded air bubbles to pass through the paint layer and disappear. If the insulating layer is further heated, air in the gaps between conductors will expand and pass to the outside and escape through the layer. As a result, the final insulating coating may have blisteres in its surface but no tiny air bubbles left in its interior. On the other hand, the radiation-curable paint which is cured as soon as it is applied allows insufficent time for the air bubbles to reach the surface of the applied layer.

In order to solve these problems, the present inventors, after applying a radiation-curable paint to twisted conductors, intentionally heated them so that the viscosity of the paint would be sufficiently reduced to allow for the air bubbles to float to the surface of the applied layer. Subsequently, the layer was hardened by radiating by either UV rays or electron beams. As was initially expected, the resulting insulating coating had no air bubbles. The heating conditions necessary for reducing the viscosity of the paint and allowing for the air bubbles to float to the surface of the applied coating should be properly determined in accordance with the viscosity vs. temperature characteristics of the paint, the coating thickness, and the wire drawing speed. Generally, a furnace of a length of 1 to 2 m which is held at a temperature in the range of 100° to 250° C. will serve the purpose. In this case, the twisted wire is preferably held at a temperature between 60° and 150° C. If the furnace temperature is too high, air in the gaps between the twisted conductors may be expanded thermally and will remain in the final coating as air bubbles.

Figure 6:
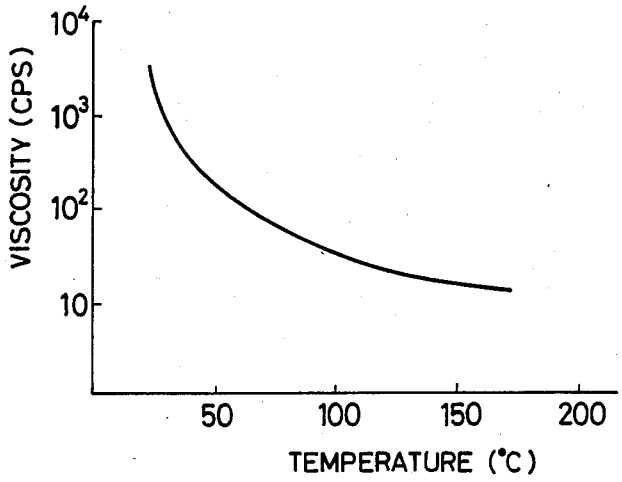
FIG. 6 is a temperature vs. viscosity curve for the solvent-free radiation-settable paint.

If the radiation-curable paint used has such viscosity vs. temperature characteristic that its viscosity adequately decreases with increasing temperature as shown in FIG. 6, the surface of the paint coating layer will soon become smooth after the air bubbles have been released therefrom. However, a coating with an uneven surface may result from a paint whose viscosity is not reduced by a sufficient degree with increasing temperature to provide a smooth-surfaced coat. If such a paint is to be used, some provision must be made to provide a smooth-surfaced coating, for example, by slowing the curing rate. The number of layers of radiation-curable paint to be applied should vary with the desired coating thickness. If the thickness of a coating later formed by a single application is in the range of about 10 to 20 microns, any air bubbles in the paint will disappear as a result of the drop in the viscosity of the paint, following the subsequent heating.

In accordance with the other method for eliminating air bubbles from the applied coating of heat-curable paint, a vacuum compartment is provided below the bath of paint and the twisted conductors are passed through this vacuum compartment so as to remove any air from the area surrounding the conductors. By subsequently introducing the conductors into the paint bath, a coating layer of the radiation-curable paint that is entirely free from air bubbles is formed on the twisted conductors.

One advantage of this method is that there is no need to provide a heating chamber subsequent to the coating step. The purpose of the vacuum compartment provided below the paint bath is to eliminate air that has been introduced by the twisted conductors and to introduce the air-free conductors into the paint bath. The amount of air bubbles that will enter the paint bath is reduced as the pressure in the vacuum compartment becomes lower than one atmosphere. Preferably, the pressure in the vacuum compartment is lower than 150 mmHg, and at such low pressures, the inclusion of air bubbles in the insulating coating is eliminated almost completely and an insulated twisted wire having stable electrical characteristics can be obtained. If the pressure in the vacuum compartment is higher than 150 mmHg, very small air bubbles may be incorporated in the final insulating coating. It should, however, be noted that as the pressure in the vacuum compartment is reduced, it becomes more likely that the paint in the bath will be drawn into the vacuum compartment. In order to avoid this backflow of paint, an elastic packing such as one made of rubber is provided at the interface between the paint bath and the vacuum compartment, and at the same time, the aperture in the bottom wall of the paint bath through which the twisted conductors are to pass should have a sufficiently small diameter as to avoid the packing from becoming deformed by the suction created under reduced pressure. Additionally, as the pressure in the vacuum compartment is reduced, the chance of air entering the vacuum compartment through the passage hole or aperture in the bottom wall is increased. This must be prevented, for example, by placing an elastomer such as rubber on the bottom of the vacuum compartment. Even if the pressure in the vacuum compartment is reduced, the elasticity of the rubber will decrease the diameter of the aperture through which the twisted conductors passes. If desired, the elastomer can be reinforced with an underlying plate so that it will satisfactorily withstand the suction developed during evacuation of the vacuum compartment. Needless to say, the aperture in the reinforcing plate through which the twisted conductors are to pass should have the smallest diameter.

The longer the twisted conductors take to pass throuth the vacuum compartment, the more air can be eliminated from the surface of the conductors. The present inventors have confirmed by experiment that a vacuum compartment with a length in the range of about 5 mm to 10 cm should suffice.

FIG. 5 shows a cross section of an insulated twisted wire fabricated by drawing twisted conductors through a paint bath having no vacuum compartment below. In FIG. 5, reference numeral 1 denotes individual twisted conductors, 2 is a gap between conductors, 8 is an insulating coating formed by applying and curing a solvent-free radiation-curable paint, 9 is an overlying insulating coating, and 10 is an air bubble. As illustrated in FIG. 5, the likelihood that tiny air bubbles are entrapped within the coating of radiation-curable paint is high if no vacuum compartment is provided below the paint bath.

Figure 7:
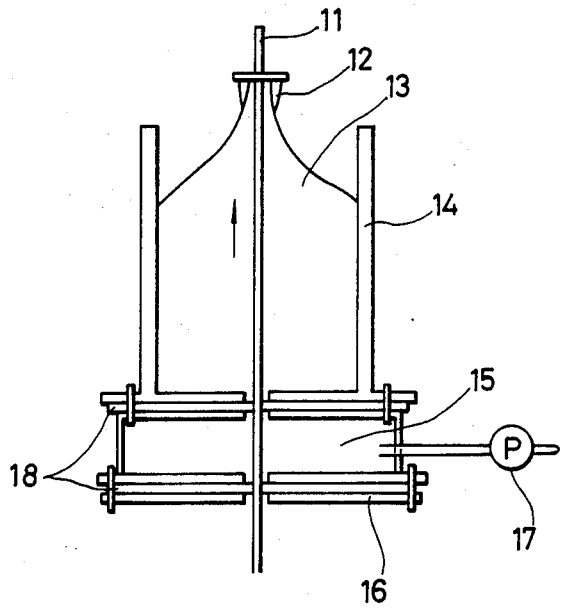
FIG. 7 is a side elevational view of a paint bath having a vacuum compartment positioned below so that twisted conductors will first pass through that vacuum compartment before they are introduced into the paint bath.

FIG. 7 illustrates a paint bath 14 that is equipped below with a vacuum comparment 15. As shown, a set of twisted conductors 11 is first introduced into the vacuum compartment before passing through the paint bath. The interior of the vacuum compartment 15 may be evacuated with a pump 17 capable of reducing the pressure in the compartment to less than 150 mmHg. The top and the bottom of the vacuum compartment are each sealed with a packing 18, and the bottom of the compartment is reinforced by an underlying plate 16. By causing the twisted conductors to pass through the vacuum compartment prior to their introduction into the paint bath, the amount of air bubbles that enter the paint bath is drastically reduced, and substantially no air bubbles are included in the cured coat of radiation-curable paint.

Examples of insulating paints that can be used in the practice of the present invention and which are capable of curing upon radiation by UV rays or electron beams include those which are based on polyester acrylate, polyol acrylate, urethane acrylate, epoxy acrylate, silicone acrylate, polybutadiene acrylate, melamine acrylate, polyene/polythiol and unsaturated polyester. These polymers as paint bases may be used either alone or in admixtures. The radiation-curable paints listed above must contain photosensitizers if they are to be hardened by radiation with UV rays. Any of the known photosensitizers may be used, which include benzoin alkyl ethers such as benzoin ethyl ether and benzoin-n-butyl ether, acetophenone derivatives such as diethoxyacetophenone, and amyl oxime esters.

Figure 4:
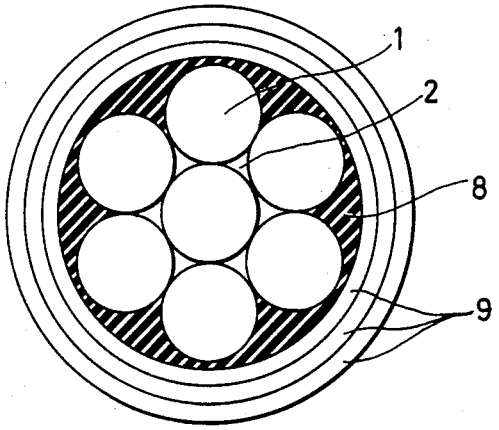
FIG. 4 is a cross section of an insulated twisted wire fabricated in accordance with one aspect of the method of the present invention, wherein twisted conductors are first coated with a solvent-free radiation-settable paint, and after curing the applied layer, the conductors are coated with an insulating paint, followed by curing the applied coating.

The insulating coating indicated at 6 in FIG. 2 or 9 in FIGS. 4 and 5 may be formed from any known insulating paint such as those based on polyvinylformal, polyurethane, polyester, polyester imide, polyamideimide and polyimide; hot-melt type insulating paints; and radiation-curable paints. These paints may be used either independently or in admixtures.

The twisted conductors to be provided with a thin insulating coating in accordance with the present invention may be made of any common conducting materials such as copper, copper alloys, tin-plated copper and solder-plated copper. In FIGS. 1 to 5, seven conductors are twisted together but this is only an example and a smaller or greater number of conductors may be twisted together. There is also no limitation on the size of the metal twisted conductors that can be treated in accordance with the present invention.

The following Examples and Comparative Examples are provided for further illustration of the claimed method and should not be construed as limiting.

COMPARATIVE EXAMPLE 1

A set of seven twisted copper conductors (0.06 mm in diameter) was coated with a polyurethane base insulating paint (viscosity: 4,000 cps, concentration: 40%) by passing through a die, and the applied layer was subsequently baked at 300° C. The wire speed was 20 m/min. Such coating and baking cycles were repeated five times. The resulting insulating coating had an average of three to 10 blisters per meter of wire. The characteristics of the insulated wire are shown in Table 1.

COMPARATIVE EXAMPLE 2

A set of seven twisted copper conductors (0.05 mm in diameter) was coated with a polyester base insulating paint (viscosity: 3,500 cps, concentration: 40%) by passing through a die, and the applied layer was subsequently baked at 320° C. The wire speed was 20 m/min. Such coating and baking cycles were repeated eight times. The resulting insulating coating had an average of two to seven blisters per meter of wire. The characteristics of the insulated wire are shown in Table 1.

COMPARATIVE EXAMPLE 3

A set of seven twisted copper conductors (0.10 mm in diameter) was coated with a polyamideimide base insulating paint (solvent: 8/2 mixture of N-methyl-2-pyrrolidone/naphtha, viscosity: 4,200 cps, concentration: 25%) by passing through a die and the applied layer was subsequently baked at 320° C. The wire speed was 18 m/min. Such coating and baking cycles were repeated six times. The resulting insulating coating had an average of 30 to 70 blisters per meter of wire. The characteristics of the insulated wire are shown in Table 1.

COMPARATIVE EXAMPLE 4

The procedures of Comparative Example 3 were repeated except that the twisted conductors were dipped in a xylol solvent prior to coating with the polyamideimide base insulating paint. The resulting insulating coating had an average of 20 to 70 blisters per meter of wire. The characteristics of the insulated wire are shown in Table 1.

COMPARATIVE EXAMPLE 5

A set of seven twisted tin-plated copper conductors (0.127 mm in diameter) was coated with a solvent-free radiation-curable paint (viscosity: 3,500 cps at 30° C.) by passing through a die. The paint was Aronix 6100 (an ester acrylate oligomer of Toagosei Chemical Co., Ltd., in Japan) and 1.5 wt% of a photosensitizer (Sundray #1000 of Mitsubishi Petrochemical Company, Ltd., in Japan). The applied layer was subsequently hardened by exposing to a 3 kW ultraviolet lamp. The wire speed was 20 m/min. Such coating and curing cycles were repeated four times. The resulting insulating coating contained three to 20 tiny (about 10 microns in diameter) air bubbles per meter of wire. The characteristics of the insulated wire are shown in Table 2 below.

COMPARATIVE EXAMPLE 6

A set of seven twisted copper conductors (0.127 mm in diameter) was coated with a solvent-free radiation-curable paint (viscosity: 5,200 cps at 30° C.) by passing through a die. The paint was a 1:1 mixture of VR-90 (epoxy acrylate oligomer of Showa Highpolymer Co., Ltd., in Japan) and Aronix 6100 (ester acrylate oligomer of Toagosei Chemical Co., Ltd.). The applied layer was hardened by exposing to a total dose of 7 Mrad of electron beams in a nitrogen atmosphere. The wire speed was 20 m/min. Such coating and curing cycles were repeated four times. The resulting insulating coating contained 10 to 30 tiny (about 10 microns in diameter) air bubbles per meter of wire. The characteristics of the insulated wire are shown in Table 2.

COMPARATIVE EXAMPLE 7

The procedures of Comparative Example 6 were repeated except that the twisted conductors were introduced into the paint bath after passing through a vacuum compartment held at 300 mmHg. The resulting insulating coating contained five to 20 tiny (about 10 microns in diameter) air bubbles per meter of wire. The characteristics of the insulated wire are shown in Table 2.

EXAMPLE 1

The procedures of Comparative Example 1 were repeated except that three layers of polyurethane base insulating paint (viscosity: 90 cps) were first formed with a felt at a speed of 25 m/min. The baking temperature was 300° C. The resulting insulated twisting wire had an insulating coating having a good appearance with no blisters. The characteristics of the wire are shown in Table 1.

EXAMPLE 2

The procedures of Comparative Example 2 were repeated except that two layers of polyester base insulating paint (viscosity: 240 cps) were first formed by roller coating at a speed of 25 m/min. The baking temperature was 320° C. The resulting insulated twisted wire had an insulating coating having a good appearance with no blisters. The characteristics of the wire are shown in Table 1.

EXAMPLE 3

The procedures of Comparative Example 3 were repeated except that the twisted conductors were dipped in a pyrrolidone solvent before they were coated with the polyamideimide base insulating paint. The resulting insulated twisted wire had an insulating coating having a good appearance with no blisters. The characteristics of the wire are shown in Table 1.

EXAMPLE 4

The procedures of Comparative Example 3 were repeated except that the twisted conductors were first electrodeposited (7 volts dc) with an anionic acrylic water-dispersible paint (concentration: 25%) at a speed of 20 m/min. After washing with water, the conductors were passed through a baking chamber at 320° C. Thereafter, the conductors were coated with a polyamideimide insulating paint and cured as shown in Comparative Example 3. The resulting insulated twisted wire had an insulating coating with no blisters. The characteristic of the wire are shown in Table 1.

EXAMPLE 5

The procedures of Comparative Example 1 were repeated except that the twisted conductors were first coated with a solvent-free radiation-curable paint (for its composition, see Comparative Example 5) by means of a felt applicator, followed by curing of the applied layer by exposing to a 3 kW UV lamp. The wire speed was 20 m/min, and the coating and curing cycles were repeated twice. Thereafter, the conductors were coated with a polyurethane base insulating paint as shown in Comparative Example 1. The resulting insulated twisted wire had an insulating coating having a good appearance with no blisters. The characteristics of the wire are shown in Table 1.

EXAMPLE 6

The procedures of Comparative Example 2 were repeated except that the twisted conductors were first coated with a solvent-free radiation-curable paint (for its composition, see Comparative Example 6) by means of a felt applicator, followed by curing of the applied layer by exposing to a total dose of 7 Mrad of electron beams in a nitrogen atmosphere. The wire drawing speed was 20 m/min, and only one coating and curing cycle was performed. Thereafter, the conductors were coated with a polyester base insulating paint as shown in Comparative Example 2. The resulting insulated twisted wire had an insulating coating having a good appearance with no blisters. The characteristics of the wire are shown in Table 1.

EXAMPLE 7

The procedures of Comparative Example 5 were repeated except that the conductors coated with a solvent-free radiation-curable paint were passed through a heating chamber (230° C., 1.5 m long) before the coating was cured by exposing to UV rays. The resulting insulating coating contained no small air bubbles. The characteristics of the insulated twisted wire are shown in Table 2.

EXAMPLE 8

The procedures of Comparative Example 6 were repeated except that the twisted conductors coated with the solvent-free radiation-curable paint were passed through a heating chamber (240° C., 1.5 m in length) before the applied layer was hardened by exposing to electron beams in a nitrogen atmosphere. The resulting insulatng coating did not contain any small air bubbles. The characteristics of the insulated twisted wire are shown in Table 2.

EXAMPLE 9

The procedures of Comparative Example 5 were repeated except that the twisted conductors were passed through a vacuum compartment (80 mmHg) before they were introduced into the paint bath. Since no air bubbles entered the paint bath, a cured insulating coating having no air bubbles was obtained. The characteristics of the insulated twisted wire are shown in Table 2.

EXAMPLE 10

The procedures of Comparative Example 6 were repeated except that the twisted conductors were passed through a vacuum compartment (100 mmHg) before they were introduced into the paint bath. Since no air bubbles entered the paint bath, a cured insulating coating having no air bubbles was obtained. The characteristics of the insulated twisted wire are shown in Table 2.

In Comparative Examples 1 to 3, the twisted conductors were coated with highly viscous insulating paints by passing through a die, and the resulting insulating coatings had many blisters. In Example 1, the bottom insulating coating was formed by applying a low-viscosity (90 cps) heat-curable paint with a felt applicator. In Example 2, the bottom layer insulating coating was formed by roller coating a low-viscosity (240 cps) heat-curable paint. Therefore, no blistering occurred in the insulating coatings finally obtained in Examples 1 and 2.

In Comparative Example 4, the polyamideimide insulating paint was applied to the conductors after they were dipped in the xylol solvents which was not highly miscible with that particular insulating paint. Therefore, the resulting insulating coating had blisters. In Example 3, no such blisters occurred since the polyamideimide paint was applied to the conductors after they were dipped in the highly miscible N-methyl-2-pyrrolidone solvent.

In Example 4, the polyamideimide base insulating paint was applied after the aqueous electrolytic paint was electrodeposited on the twisted conductors and cured. Therefore, no blistering occurred in the resulting insulating coating.

In Example 5, the polyurethane base insulating paint was applied to the twisted conductors after the paint that was curable upon radiating by UV rays was applied and cured. In Example 6, the polyester base insulating paint was applied to the twisted conductors after the paint that was curable upon radiating by electron beams had been applied and cured. No blistering occurred in either of the insulating coatings formed in Examples 5 and 6.

In Comparative Examples 5 and 6, wherein paints curable by exposing to UV rays or electron beams were respectively applied to the twisted conductors and subsequently cured, the insulating coatings obtained had no blisters but contained many air bubbles. In Examples 7 and 8, the twisted conductors having coatings of radiation-cured paints were passed through the heating chamber before the coatings were cured. Since any air bubbles present in the coatings were eliminated during the passage through the heating chamber, the finally obtained insulating coating contained no air bubbles.

In Comparative Example 7, the conductors were passed through a vacuum compartment before they were introduced into the paint bath, but the pressure in that compartment was 300 mmHg, that is, a pressure higher than 150 mmHg, the preferred value for the purposes of the present invention. Therefore, the cured insulating coating contained a significant number of air bubbles, although they were not as many as in the coating of Comparative Example 6. In Examples 9 and 10, the pressures in the vacuum compartment were respectively 30 mmHg and 50 mmHg, well below the preferred value of 150 mmHg. Therefore, the insulating coatings prepared in these Examples were entirely free from air bubbles.

TABLE 1

| | Comparative Examples | | | | Examples | | | | | |
|---|---|---|---|---|---|---|---|---|---|---|
| Factors[1] | 1 | 2 | 3 | 4 | 1 | 2 | 3 | 4 | 5 | 6 |
| OD of twisted Wire (mm) | 0.183 | 0.155 | 0.320 | 0.320 | 0.183 | 0.155 | 0.320 | 0.320 | 0.183 | 0.155 |
| Final OD (mm) | 0.235 | 0.213 | 0.370 | 0.370 | 0.238 | 0.215 | 0.370 | 0.370 | 0.235 | 0.213 |
| Coating thickness (mm) | 0.024 | 0.029 | 0.025 | 0.025 | 0.028 | 0.030 | 0.025 | 0.025 | 0.024 | 0.029 |
| Adhesion to conductors | good | good | good | good | good | good | good | good | good | good |

TABLE 1-continued

| Factors[1] | Comparative Examples 1 | 2 | 3 | 4 | Examples 1 | 2 | 3 | 4 | 5 | 6 |
|---|---|---|---|---|---|---|---|---|---|---|
| Flexibility | good | good | good | good | good | good | good | good | good | good |
| Number of pinholes/5 m | 5–20 | 3–15 | 7–20 | 6–18 | 0–3 | 0–3 | 0–2 | 0–3 | 0–2 | 0–3 |
| Breakdown voltage of twisted pair (kV) | 1.8–3.0 | 2.0–3.8 | 2.1–3.7 | 2.0–3.5 | 2.5–4.0 | 2.8–5.0 | 2.9–5.1 | 2.7–5.0 | 3.0–5.5 | 3.2–5.7 |
| Number of blisters/$m^2$ | 3–10 | 2–7 | 30–70 | 20–70 | 0 | 0 | 0 | 0 | 0 | 0 |

[1]All measurements of factors were made in accordance with JIS C 3003.
[2]The number of blisters was counted under observation with a stereomicroscope (× 70).

TABLE 2

| Factors[1] | Comparative Examples 5 | 6 | 7 | Examples 7 | 8 | 9 | 10 |
|---|---|---|---|---|---|---|---|
| OD of twisted wire (mm) | 0.385 | 0.386 | 0.386 | 0.385 | 0.386 | 0.386 | 0.386 |
| Final OD (mm) | 0.471 | 0.470 | 0.470 | 0.471 | 0.470 | 0.470 | 0.470 |
| Coating thickness (mm) | 0.043 | 0.042 | 0.042 | 0.043 | 0.042 | 0.042 | 0.042 |
| Adhesion to conductors | good | good | good | good | good | good | good |
| Flexibility | good | good | good | good | good | good | good |
| Number of pinholes/5 m | 0 | 0 | 0 | 0 | 0 | 0 | 0 |
| Breakdown voltage of twisted pair (kV) | 8–13 | 7–13 | 8–13 | 10–15 | 9–15 | 10–15 | 9–15 |
| Number of blisters/$m^2$ | 0 | 0 | 0 | 0 | 0 | 0 | 0 |
| Number of air bubbles/$m^2$ | 3–20 | 10–30 | 5–20 | 0 | 0 | 0 | 0 |

[1] *and* [2] See the footnotes to Table 1.

We claim:

1. A process for producing an insulated twisted electric wire comprising a plurality of metal conductors which are twisted together, said process comprising: providing said twisted electric wire with an insulating coating having a thickness in a range of 3 to 100% of the radius of a smallest circle circumscribing said conductors, said insulating coating being formed by two or more cycles of coating and curing of an insulating paint, wherein said step of providing said insulating coating comprises the steps of applying a paint that hardens upon radiating by ultraviolet rays or electric beams on said twisted electric wire, hardening the applied layer by said radiation by ultraviolet rays or electron beams, and then applying and curing an insulating paint in cycles to form a plurality of insulating coating layers.

2. The process according to claim 1, further comprising the step of passing said twisted electric wire to which said radiation-hardenable paint has been applied through a heating chamber so as to eliminate gas bubbles in said applied layer, and thereafter, exposing said electric wire to ultraviolet rays or electron beams to harden said layer.

3. The process according to claim 1, further comprising the step of passing said twisted electric wire through a vacuum compartment to eliminate wire from an area surrounding said electric wire, and then immediately introducing said electric wire into a bath of hardenable paint to apply said paint, and subsequently hardening said hardenable paint by exposing to ultraviolet rays of electron beams.

4. The process according to claim 3, wherein a pressure in said vacuum compartment is lower than 150 mmHg.

* * * * *